United States Patent [19]

Goforth et al.

[11] 4,389,388

[45] Jun. 21, 1983

[54] DESULFURIZATION OF PETROLEUM COKE

[75] Inventors: Charles P. Goforth, Tulsa; John A. Hamshar, III, Owasso, both of Okla.

[73] Assignee: Cities Service Company, Tulsa, Okla.

[21] Appl. No.: 351,051

[22] Filed: Feb. 22, 1982

[51] Int. Cl.[3] ..... C01B 31/02; C01B 17/16; C10L 9/04

[52] U.S. Cl. ..... 423/461; 423/563; 201/17; 44/1 SR

[58] Field of Search ..... 423/461; 201/17; 44/1 SR

[56] References Cited

U.S. PATENT DOCUMENTS

| | | | |
|---|---|---|---|
| 2,717,868 | 9/1955 | Gorin et al. | 201/17 |
| 2,814,588 | 11/1957 | Hutchings | 201/17 |
| 2,983,673 | 5/1961 | Grove | 201/17 |
| 4,013,426 | 3/1977 | Schroeder | 44/1 SR |
| 4,268,358 | 5/1981 | Schuster | 201/17 |
| 4,291,008 | 9/1981 | Hsu et al. | 423/461 |
| 4,359,451 | 11/1982 | Tipton | 423/461 X |

*Primary Examiner*—Brian E. Hearn
*Assistant Examiner*—Steven Capella
*Attorney, Agent, or Firm*—George L. Rushton

[57] ABSTRACT

Petroleum coke is processed to reduce the sulfur content. Ground coke is contacted with hot hydrogen, under pressurized conditions, for a residence time of about 2 to 60 seconds. The desulfurized coke is suitable for metallurgical or electrode uses.

2 Claims, 3 Drawing Figures

DESULFURIZATION OF PETROLEUM COKE

BACKGROUND OF THE INVENTION

This invention concerns the desulfurization of petroleum coke. More particularly, it relates to the treatment of petroleum coke at elevated temperatures and pressures in the presence of hydrogen.

Petroleum coke, as produced from sour crude oils by known and recognized processes, contains sulfur, in various forms, in the range of about 3 to 6 wt.%. Coke used for metallurgical or electrode purposes requires a reduction in the sulfur content, to about 1 to 1½ wt.%, and a low volatile matter content. This lower sulfur and volatile content coke commands a substantially higher price than ordinary petroleum coke sold for its fuel value. Typically, electrode manufacturers grind and calcine crude petroleum coke to obtain the specifications on sulfur and volatile matter.

Various methods have been used to reduce the sulfur content of petroleum coke. Heating of coke to a temperature of about 2600° F. (1425° C.), to remove a maximum amount of sulfur while it is in an "absorbed" or easily removable form, is one suggested method. Another process uses a plurality of heating zones, with the coke being held at various temperatures for various times. A different process includes the steps of contacting coke with hydrogen at a superatmospheric pressure and at a temperature at which substantial desulfurization occurs, but below the temperature at which substantial volatilization of the charge occurs. Another process desulfurizes coke by the use of hydrogen at relatively low temperatures and at a high pressure. Broadly, the above-described processes involve relatively lengthy residence times, such as from a few minutes to a few hours.

SUMMARY OF THE INVENTION

The present invention reduces the sulfur content of a relatively high-sulfur petroleum coke by subjecting the coke to a high temperature, high pressure treatment in the presence of hydrogen, at a relatively short residence time.

This process of desulfurization and devolatilization of petroleum coke broadly involves the steps of grinding petroleum coke and introducing this ground coke into a reactor. In the reactor the coke is contacted with hot high-pressure hydrogen, so as to heat the coke rapidly to the desired reaction temperature, and is held at this reaction temperature for a relatively short residence time. The treated coke is then removed from the reactor.

By producing a coke having lowered sulfur and volatile matter content, the invention saves the electrode manufacturer a calcining step.

DESCRIPTION OF THE DRAWINGS

The drawings show three embodiments of the invention.

DETAILED DESCRIPTION OF THE INVENTION

Figure 1:
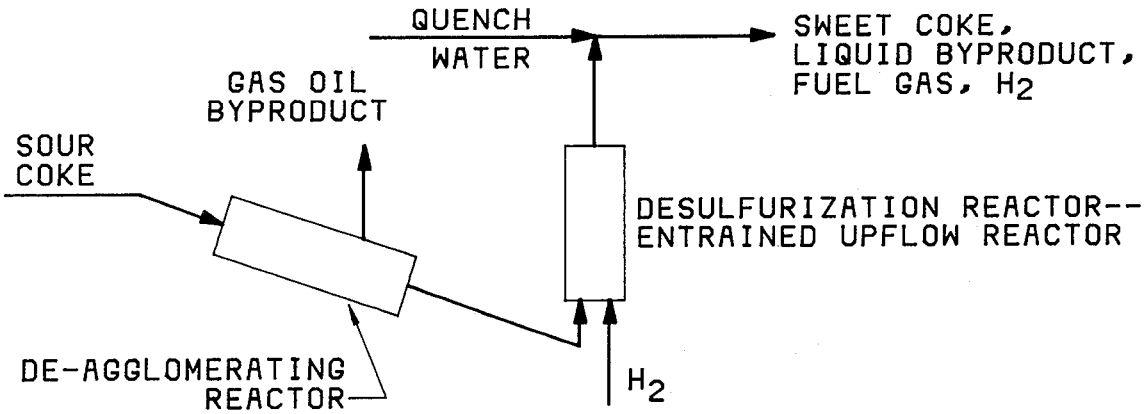
FIG. 1 is a block diagram of the process involving a de-agglomeration reactor and a desulfurization reactor.

The invention concerns the desulfurization and devolatilization of petroleum coke by the use of short residence time hydrogenation technology.

Crude petroleum coke is a commercial product, prepared by a number of manufacturers. Broadly, the coke is characterized by a relatively high sulfur content, such as from about 3 to about 6 wt.%, volatile matter content of about 5 to 15 wt.% and ash content of about 0.1 to 1 wt.%.

Since we have found during testing that, broadly, the ease of sulfur removal is generally inversely proportional to the particle size, the raw petroleum coke is ground to a particle size, such that at least 90 wt.% passes through a No. 50 sieve (U.S. Sieve Series). Grinding to a smaller particle size is acceptable but may not be commercially efficient.

The ground coke is introduced into a reactor, where it is contacted by hot hydrogen, typically in concurrent and turbulent flow. The temperature of the hydrogen stream can vary from about 870° C. (1600° F.) to about 1370° C. (2500° F.), with the hydrogen/coke wt. ratio varying from about 0.05 to about 10. Excess hydrogen is typically separated from the product stream and recycled, having a purity of about 60 to 90%.

With rapid agitation of the reactants, such as by turbulent or tangential flow, the coke particles are rapidly heated to a reaction temperature varying from about 700° C. (1290° F.) to about 980° C. (1800° F.). The hydrogen partial pressure in the reactor varies from about 300 psi to about 2000 psi (21 kg/cm$^2$ to 141 kg/cm$^2$). The treated coke is then cooled and removed from the reactor.

The total residence or contact time, at reaction temperature, including heat up, reaction, and cooling times, varies from about 2 to about 60 seconds.

The volatile matter by proximate analysis is determined by known methods.

Coke from the pyrolysis of coal can be used as feed in this process, but coal coke has different properties, such as volatile and ash content. Coke derived from processing of tar sands bitumen and from oil shale kerogen can also be used.

One variation in the typical process concerns leaching of the ground coke feed with 1 N HCl at 150° F. for 2 hours, followed by washing and drying of the coke. This pretreatment typically results in a lowering of the sulfur content of the feed before the hydrogenation treatment.

Another variation in the procedure concerns the potential agglomeration of coke obtained from sour crude. Anti-agglomerating treatments were tried, such as acid washing with HCl and air pretreatment. Leaching the coke with toluene was partially effective, but a small amount of residual toluene was left on the coke and was not easily removed before the hydrogenation treatment. Pyrolysis of the untreated coke for 30 minutes in a nitrogen atmosphere at 850° F. (455° C.), followed by regrinding of the product, gave a feed material which was no longer agglomerating.

EXAMPLE 1

This embodiment concerns the use of delayed coke having sufficient volatile matter to cause agglomeration in the desulfurization reactor. As shown in FIG. 1, a de-agglomerating reactor is used to remove enough volatile material to make the coke non-agglomerating. The de-agglomerating reactor, as shown in FIG. 1, is exemplified by a rotating kiln operating at 850° F. (455° C.) and approximately atmospheric pressure of inert recycle gas. The reactor has internal baffles to reduce agglomeration. Typical residence time is about 30 minutes, depending on the volatile content of the feed coke and the desired product.

The partially devolatilized coke is then fed to the pressurized desulfurization reactor, concurrently with heated hydrogen. The mixture is entrained upwardly toward the reactor outlet. The sour coke feed to the de-agglomerating reactor is a product from Arabian crude and is crushed to 99 wt.% through 50 mesh (U.S. Sieve series).

The desulfurized coke is quenched to less than 1000° F. (540° C.) by a water spray. The total effluent is processed by typical means, and the gaseous, liquid and solid products are separated. The major product, sweet coke, has a sulfur content of about 2.5 wt.%. The level of sulfur in the treated product is thus about 60 wt.% of the sulfur in the feed.

Analysis and operating parameters are:

| Coke Analysis | Feed (Wt. %) | Product |
|---|---|---|
| C | 88.8 | 92.0 |
| H | 3.6 | 2.2 |
| N | 1.4 | 1.4 |
| S | 4.2 | 2.5 |
| Ash | 0.2 | 0.3 |
| O (by difference) | 1.8 | 1.6 |
| | 100.0 | 100.0 |
| Volatile Matter | 10.7 | 5.0 |
| Desulfurizer Conditions | | |
| Ave. Reactor Temp. | 1670° F. (910° C.) | |
| Ave. Reactor Pressure | 600 psia (42.2 kg/cm$^2$) | |
| $H_2$ Purity | 83 vol. % | |
| Residence Time | 2.1 sec. | |
| $H_2$/coke feed wt. ratio | 0.1 | |
| Preheat $H_2$ temp. | 2725° F. (1495° C.) | |
| Products Per Ton Feed Coke (combined de-agglomerator and desulfurizer) | | |
| Sweet Coke (2.5 wt. % S) | 1540 lb. | |
| Gas Oil | 0.64 bbl. | |
| Fuel Gas (950 btu/scf) | 6070 scf | |
| $H_2S$ | 46 lb. | |

EXAMPLE 2

Figure 2:
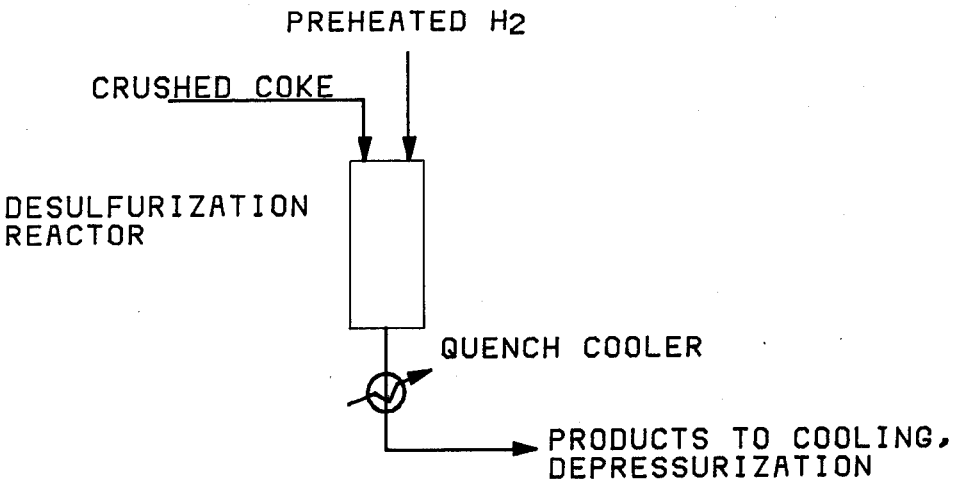
FIG. 2 is a block diagram showing a desulfurization reactor.

The invention is exemplified by the use of sour coke particles, obtained from the fluid coking of tar sands bitumen, as feed for a desulfurization reactor. The feedstock coke is crushed to pass 90% through 50 mesh (U.S. Sieve series) and is then fed by hydrogen transport to an entrained downflow reactor, as shown in FIG. 2. The coke contacts preheated hydrogen, and the temperature of the mixture is maintained at the desired temperature for the required residence time. The effluent is quenched and then processed, giving a sweet coke of reduced sulfur content as the major product. Here, the sulfur level in the product coke is about 25% of that in the feed coke.

| Coke Analysis | Feed (wt. %) | Product |
|---|---|---|
| C | 87.25 | 92.8 |
| H | 2.8 | 2.9 |
| N | 1.8 | 1.5 |
| S | 5.8 | 1.5 |

-continued

| | | |
|---|---|---|
| O (by difference) | 1.8 | 1.6 |
| Ash | 0.55 | 0.7 |
| | 100.0 | 100.0 |
| Operating Conditions | | |
| Ave. Reactor Temp. | 1780° F. (971° C.) | |
| Ave. Reactor Pressure | 2000 psia (1406 kg/cm$^2$) | |
| $H_2$ Purity | 91 vol. % | |
| Residence Time | 10 sec. | |
| $H_2$/coke feed wt. ratio | 10 | |
| Preheat $H_2$ temperature | 1800° F. (982° C.) | |
| Products Per Ton Coke Feed | | |
| Sweet Coke (1.5% S) | 1235 lb. | |
| Methane | 13777 scf | |
| Ethane | 367 scf | |
| Benzene | 0.53 bbl. | |
| $H_2S$ | 103 lb. | |

EXAMPLE 3

Figure 3:
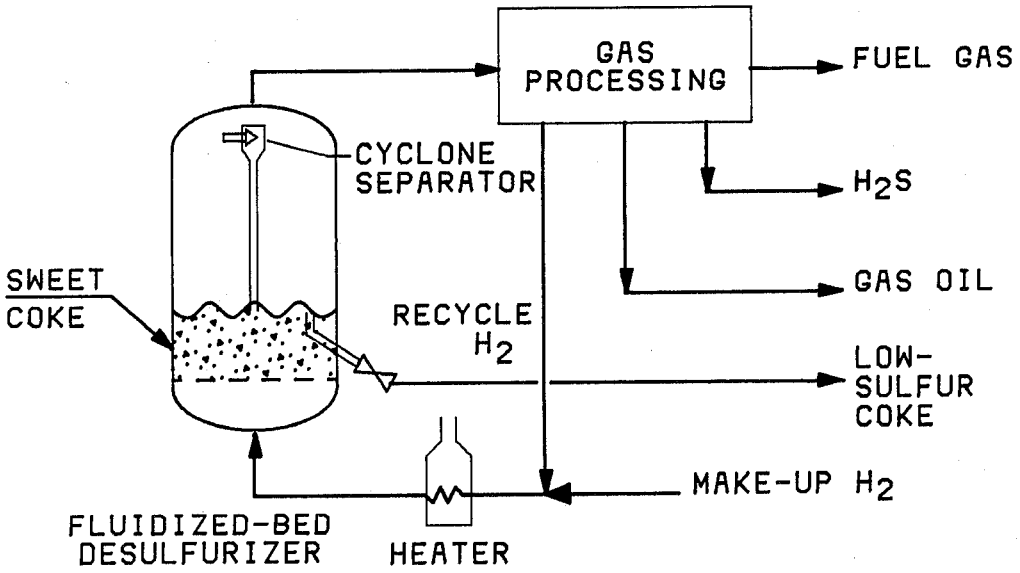
FIG. 3 is a block diagram of a fluidized-bed desulfurization reactor and associated equipment.

As shown in FIG. 3, this example utilizes a fluidized bed desulfurizer. The feed is delayed coke, which is crushed to pass 90% through 100 mesh (U.S. Sieve series). The crushed coke is fed to the reactor where it contacts hot hydrogen. The desulfurized coke is withdrawn from the bed via an overflow pipe, while the effluent gases pass through a cyclone separator and then a gas processing section. The hydrogen-rich portion of the treated gas is recycled to the desulfurizer, while the remainder of the gaseous portion is used as clean fuel gas. The product coke has a sulfur level amounting to about 40% of that of the feed coke.

| Coke Analysis | Feed (wt. %) | Product |
|---|---|---|
| C | 93.45 | 95.15 |
| H | 3.2 | 2.5 |
| N | 0.9 | 0.9 |
| S | 1.3 | 0.48 |
| O (by difference) | 1.1 | 0.9 |
| Ash | 0.05 | 0.07 |
| | 100.0 | 100.0 |
| Operating Conditions | | |
| Ave. Reactor Temp. | 1500° F. (815° C.) | |
| Ave. Reactor Pressure | 1000 psi (70.3 kg/cm$^2$) | |
| $H_2$ Purity | 75 vol. % | |
| Residence Time | 50 sec. | |
| $H_2$/Coke Feed Wt. Ratio | 0.5 | |
| Preheat $H_2$ Temperature | 1860° F. (1015° C.) | |
| Superficial Gas Velocity in Reactor | 1.1 fps | |
| Fluidized Bed Density | 28 lb/ft$^3$ | |
| Products Per Ton Coke Feed | | |
| Sweet Coke (0.48 wt. % S) | 1493 lb. | |
| Methane | 11825 scf | |
| Gas Oil | 0.26 bbl. | |
| $H_2S$ | 20 lb. | |

We claim:

1. A process for the desulfurization and devolatilization of petroleum coke comprising the serial steps of:

a. grinding the coke, b. introducing the coke into a reactor, c. contacting the coke with hydrogen, at a temperature varying from about 700° C. (1290° F.) to about 980° C. (1800° F.) and a hydrogen partial pressure varying from about 300 psig (21 kg/cm$^2$) to about 2000 psig (144 kg/cm$^2$), for a total reactor contact time of less than 60 seconds, d. cooling the coke, and e. removing the treated coke.

2. The process of claim 1 wherein:

a. the coke is ground to a size such that 90% passes through a No. 50 sieve (U.S. Sieve series), b. the H/coke wt. ratio varies from about 0.05 to about 10, c. the contact time, including heat up, reaction and quench time, varies from about 2 to about 60 seconds, d. a de-agglomerating reactor is used in the process stream upstream of the desulfurization reactor, e. the desulfurization reactor is an entrained upflow reactor, and f. the level of sulfur in the processed product varies from about 25 to about 60 wt.% of the sulfur in the feed material.

* * * * *